United States Patent [19]

Costes

[11] 4,186,629

[45] Feb. 5, 1980

[54] DEVICE FOR UNTIGHTENING AND TIGHTENING NUTS

[75] Inventor: Claude Costes, Dunkerque, France

[73] Assignee: Union Siderurgique de Nord et du l'est de la France, France

[21] Appl. No.: 854,196

[22] Filed: Nov. 23, 1977

[30] Foreign Application Priority Data

Nov. 25, 1976 [FR] France ..... 76 35564

[51] Int. Cl.[2] ..... B25B 13/00

[52] U.S. Cl. ..... 81/53 R; 81/57.3

[58] Field of Search ..... 81/54, 57, 57.3, 53; 74/DIG. 10, 461

[56] References Cited

U.S. PATENT DOCUMENTS

| | | | |
|---|---|---|---|
| 2,569,509 | 10/1951 | Wells | 81/57.3 |
| 2,839,943 | 6/1958 | Caldwell et al. | 74/DIG. 10 |
| 3,730,009 | 5/1973 | Mead et al. | 74/461 |

FOREIGN PATENT DOCUMENTS

| | | | |
|---|---|---|---|
| 2021685 | 11/1971 | Fed. Rep. of Germany | 74/DIG. 10 |
| 1082281 | 6/1954 | France | 81/57.3 |
| 707988 | 4/1954 | United Kingdom | 81/57.3 |
| 948341 | 1/1964 | United Kingdom | 74/461 |

*Primary Examiner*—James L. Jones, Jr.

*Attorney, Agent, or Firm*—Burns, Doane, Swecker & Mathis

[57] ABSTRACT

The device comprises a ring gear mounted on the outer surface of the nut and a gear pinion in mesh with the crown gear. The pinion is rotatably mounted on a fixed pin and has a cavity for receiving a device for driving the pinion in rotation.

4 Claims, 2 Drawing Figures

DEVICE FOR UNTIGHTENING AND TIGHTENING NUTS

The present invention relates to a device for untightening and retightening nuts and more particularly to such a device for untightening and retightening nuts which regulate the chock rolling bearing of rolling mill rolls.

The untightening of nuts regulating chock rolling bearings is achieved up to the present time by means of a pin wrench. The nut is disassembled by two workmen by exerting a thrust on the wrench or by striking the latter with a mallet.

Owing to the greatly tightened state of the nut and the height of the installation, the workmen are obliged to mount on the chock to carry out the work.

The chock is always covered with a thick layer of grease and scale deposit so that persons in charge of the regulating operations find it difficult to keep their balance and this considerably increases the risk of accidents.

When the untightening of a nut is found to be too difficult, it is possible to employ an overhead crane having a hook to which there is attached a sling which a pin connects to the nut to be untightened. Of course such a procedure is very dangerous for the personnel.

An object of the invention is to overcome the aforementioned drawbacks by providing a device for untightening and tightening nuts for regulating chock rolling bearings of a rolling mill roll which requires less physical force on the part of the personnel and results in a saving in time for the disassembly and reassembly of the nuts.

Another object of the invention is to carry out the assembly and disassembly operations at the height of a man so as to reduce to a minimum the risk of the personnel falling and accidents due to the throwing of the pin wrench.

According to the invention, there is provided a device for untightening and tightening nuts of large size and in particular nuts for regulating the chock rolling bearings of rolling mill rolls, the device comprising a ring gear mounted on the outer surface of the nut and a gear pinion in mesh with said ring gear and rotatably mounted on a fixed pin, said pinion having a cavity for receiving means for driving the pinion.

Further features of the invention will be apparent from the ensuing description.

Figure 2:
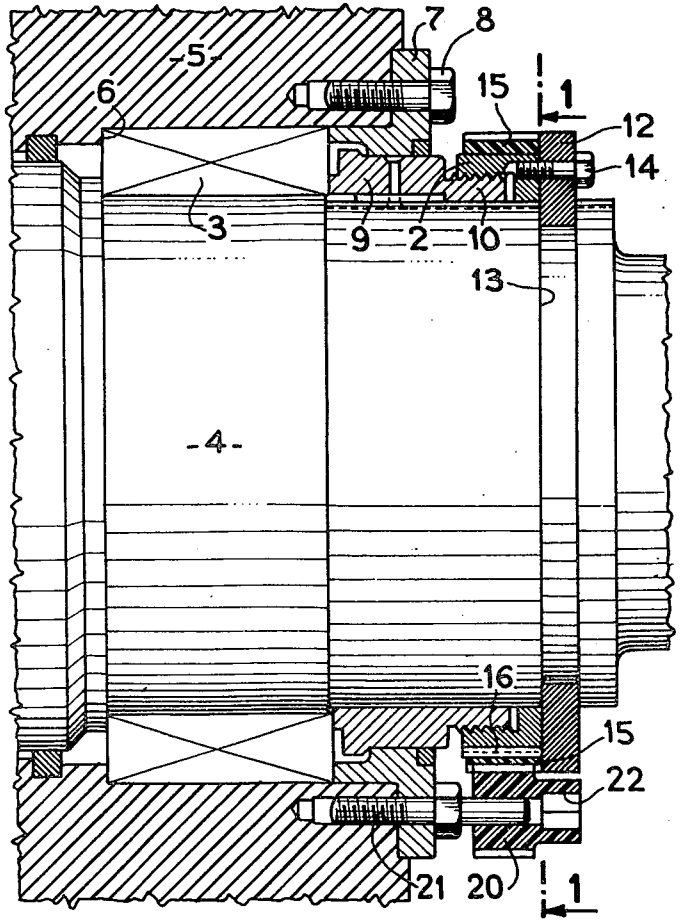
Figure 1:
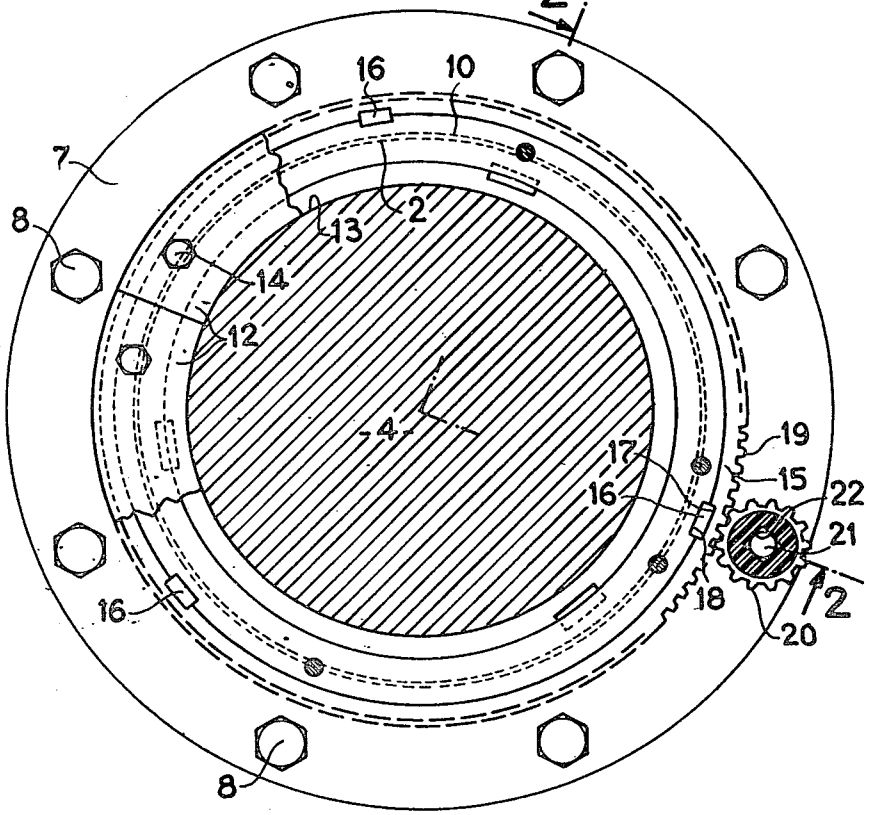

In the accompanying drawing given solely by way of example:

FIG. 1 is a front elevational view, with a part cut away, of a device for untightening and tightening nuts according to the invention, and FIG. 2 is a sectional view taken on line 2—2 of FIG. 1.

The assembly shown in FIGS. 1 and 2 comprises a nut 2 for regulating the position of a chock rolling bearing 3 of a roll 4 of a rolling mill.

The rolling bearing 3 is mounted in a bore formed in the chock 5. This bore has a shoulder 6 for the outer ring of the rolling bearing which is held stationary in the axial direction by an abutment ring 7 provided with a peripheral flange and fixed to the chock by screws 8.

Disposed between the abutment ring and the shaft of the rolling mill roll 4, is an annular member 9 for regulating the axial position of the inner ring of the rolling bearing 3. The member 9 is keyed on the shaft of the roll 4 and has a screwthreaded portion 10 which cooperates with the nut 2. The latter is held axially stationary by a collar 12 in two parts engaged in a groove 13 in the shaft of the roll 4 and fixed to the nut by screws 14.

The untightening and tightening device according to the invention comprises a ring gear 15 secured to the nut 2 by headed keys 16 engaged in axial grooves 17 and 18 provided in the nut 2 and the ring gear 15 respectively.

The outer teeth 19 of the ring gear 15 are in mesh with a driving gear pinion 20 which is rotatably mounted on a spindle constituted by a pin 21 fixed in the chock 5.

The pinion 20 has a cavity 22 of square section for receiving the male end of a pneumatic key for driving the pinion (not shown).

The pin 21 is placed in such position as to facilitate the positioning of the pinion 20 and to reduce to a minimum the effort required to maintain in position at the height of a man the key driving the pinion 20.

The ring gear 15 is made from a plastics material but it may alternatively be made from steel.

When it is disassembled from the rolling mill housing, the assembly comprising the roll and the chock is placed on a work area. The roll must then be separated from the chock to enable the surface of the roll to be ground.

The ring gear 15 has an inside diameter slightly larger than the outside diameter of the corresponding nut so as to provide a slight clearance to facilitate assembly.

As a pin 21 is mounted on each chock, the pinion 20 is placed in position manually.

When a nut tightening or untightening operation has finished, the ring gear 15 is withdrawn merely by withdrawing the keys 16 and the pinion 20.

The parts may then be used again for the tightening or untightening of another like nut.

Having now described my invention what I claim as new and desire to secure by Letters Patent is:

1. A device for untightening and tightening a nut for regulating the chock rolling bearings of rolling mill rolls, comprising:
   - a shaft of a rolling mill roll;
   - an annular member mounted on said shaft having an outer surface, a portion of which outer surface is threaded;
   - a nut having an outer surface and a threaded inner surface, which nut is screwed onto the threaded portion of said annular member;
   - a collar axially adjacent to said nut which collar is mounted on said shaft and releasably connected to said nut;
   - a ring gear including a gear member which is separate from said nut but mounted on the outer surface of the nut;
   - means fixing said gear member on the nut; and
   - a gear pinion in mesh with the ring gear and rotatably mounted on a fixed pin, the gear pinion having first means for receiving second means for driving the pinion in rotation.

2. A device as claimed in claim 1, wherein said nut has a cylindrical lateral outer surface and axial grooves are formed in confronting surfaces of said nut and said gear member and headed keys are engaged in said axial grooves and key said gear member to said nut.

3. A device as claimed in claim 1, wherein the ring gear is of metal.

4. A device as claimed in claim 1, wherein the ring gear is of plastics material.

* * * * *